United States Patent [19]

Burke

[11] 4,219,192

[45] Aug. 26, 1980

[54] SHEET LOADING AND STORING ASSEMBLY

[75] Inventor: James E. Burke, Norwalk, Conn.

[73] Assignee: Pitney Bowes Inc., Stamford, Conn.

[21] Appl. No.: 866,560

[22] Filed: Jan. 3, 1978

[51] Int. Cl.[3] ..... B65H 1/12; B65H 3/06

[52] U.S. Cl. ..... 271/160; 221/227; 271/127; 271/164

[58] Field of Search ..... 271/127, 126, 164, 162, 271/163, 160, 147, 157, 170, 171; 214/8.5 A; 221/227, 230, 197, 198; 414/118

[56] References Cited

U.S. PATENT DOCUMENTS

| | | | |
|---|---|---|---|
| 3,873,196 | 3/1975 | Ogawa | 271/170 X |
| 3,933,349 | 1/1976 | Limberger et al. | 271/127 X |
| 4,017,181 | 4/1977 | Komaba et al. | 271/127 X |
| 4,060,233 | 11/1977 | Stange et al. | 271/127 X |

*Primary Examiner*—Bruce H. Stoner, Jr.
*Attorney, Agent, or Firm*—Lawrence E. Sklar; William D. Soltow, Jr.; Albert W. Scribner

[57] ABSTRACT

An improvement in a machine, typically a photocopy machine which utilizes individual sheets of paper which are stored in the machine as a stack of sheets and having feeding means for feeding the uppermost sheet from the stack. A removable tray having a movable support member therein is normally disposed in the machine, and an elevating mechanism automatically raises the support member in the tray in order to bring the topmost sheet of the stack into engagement with the feeding means. Camming members in the tray and the elevating mechanism cooperate with each other to depress the elevating mechanism to an inoperative position when the tray is being inserted into and removed from the machine. The above improvement is equally adaptable to use as an independent sheet feeding mechanism.

7 Claims, 8 Drawing Figures

SHEET LOADING AND STORING ASSEMBLY

BACKGROUND OF THE INVENTION

1. Field of the Invention

It is well known that there are a multitude of machines in which sheets of paper cut to a predetermined size are utilized for one purpose or another. One such machine is the typical office photocopy machine in which sheets of copy paper are stored in the form of a stack of sheets and in which the copy machine produces a copy of an original document. As will be fully apparent hereinafter, the improvement of the present invention is applicable to any other machine in which cut sheet paper is utilized and in which the sheets of paper are stored and are fed seriatim to some processing apparatus. It is even possible that the present invention could be utilized as an independent sheet feeding apparatus from which sheets are fed for a purpose other than being utilized in a machine, such as the input device for a sorter, or for automatically loading of a collator. Other examples are apparent.

2. Prior Art

It has been typical practice heretofore in all such machines or mechanisms which feed sheets of paper stored as a stack to manually deposit a stack of sheets into some form of receptacle or storage member built into the machine or mechanism, and to engage a feeding device with the top most sheet of the stack. Usually the feeding device must be moved out of the way in order for the stack of sheets to be placed in an operative position. More recently, it has been the practice to pre-load a stack of sheets into a removable tray, receptacle or cassette and then insert the tray, receptacle or cassette into the operating machine or feeding apparatus and then engage the feeding device with the topmost sheet. This, of course, eliminates the obvious difficulties of having to handle a stack of loose sheets other than merely placing the stack into an easily accesible tray or receptacle. However, the difficulties associated with operatively engaging the feeding device with the topmost sheet are still present.

As exemplified by these patents, U.S. Pat. Nos. 3,563,535, 3,919,972 and 3,977,666, it is typical to provide removable trays, receptacles or cassettes for storing a stack of sheets in a machine, but in each instance it is necessary for the operator to perform a manual operation on the machine in order to disengage the feeding device of the machine so that the tray or receptacle can be removed and then to perform another operation in order to re-engage the feeding device with the topmost sheet of the stack after the tray or receptacle is inserted into the machine or feeding mechanism, as the case may be.

The present invention eliminates the secondary steps in the loading process since it does not require opening and closing doors, depressing spring loaded supports or moving selection handles when inserting or removing trays, receptacles or cassettes, all as required by the prior art machines. In the present invention, regardless of whether embodied as an improvement in a machine which utilizes sheets of paper or in an independent feeding apparatus, the operator merely pulls the tray, receptacle or cassette out of the machine or feeding apparatus when it is time to replenish the paper and re-insert the tray, receptacle or cassette loaded with paper, and the paper is automatically placed into operative engagement with a feeding device without further manual operations being necessary.

SUMMARY OF THE INVENTION

The present invention relates generally to a sheet loading and storing assembly for a stack of cut sheets, and more particularly to an assembly for inserting and supporting a stack of sheets in position for feeding in which the supporting mechanism is automatically engaged and disengaged.

In one of its broader aspects, the invention resides in an improvement in a machine which utilizes individual sheets of paper stored therein as a stack of sheets and has a feeding means for feeding the uppermost sheet from the stack, the improvement being a means for inserting and supporting the stack of sheets in an operative position in the machine for feeding of individual sheets seriatim from the top of the stack. A receptacle is removably disposed in the machine in an operative position for holding a stack of sheets, the receptacle having a movable support member therein for supporting the stack of sheets. A movable elevating mechanism is mounted in the machine for automatically elevating the support member in the receptacle to an operative position at which the uppermost sheet of the stack is in feeding engagement with the feeding means when the receptacle is in its operative position. There are means on the receptacle and on the elevating means which operatively engage with each other when the receptacle is inserted into and removed from the machine for moving the elevating means to an inoperative position in which the elevating means is depressed beneath the receptacle so that the receptacle is inserted into and removed from the machine without interference with the elevating means and the latter is automatically rendered operable after the receptacle is inserted into the machine.

In another of its broader aspects, the invention resides in an independent sheet feeding apparatus having the same structured configuration as just described but with the inclusion of a sheet feeding device incorporated with the independent apparatus.

In some of its more limited aspects, the present invention includes an elevating mechanism which is normally biased to an operative range of positions in the machine, and these are cooperating camming members on the receptacle and on the elevating mechanism for depressing the latter to an inoperative position during insertion and removal of the receptacle. The camming members preferably are forwardly and rearwardly facing surfaces on the tray or receptacle which operate on first and second camming surfaces respectively on the elevating mechanism so that the forwardly facing camming surface on the tray presses downwardly on the first camming surface of the elevating mechanism to depress the elevating mechanism to an inoperative position beneath the tray when the tray in being inserted into the machine. When the tray is fully inserted, the elevating mechanism automatically assumes one of a range of positions where it presses the topmost sheet of the stack into engagement with the feeding device since the elevating mechanism is normally biased upwardly toward the feeding device. Upon removal of the tray, the rearwardly facing camming surface on the tray operates on the second camming surface on the elevating mechanism to again depress the elevating mechanism to the inoperative position to allow full withdrawal of the tray.

Having briefly described the general nature of the present invention, it is a principal object thereof to provide a sheet loading and storing assembly which is adaptable for use either in a machine which utilizes individual sheets of paper stored therein as a stack or in an independent sheet feeding apparatus from which sheets are fed seriatim.

It is another object of the present invention to provide a sheet loading and storing assembly for use as above stated in which a stack of sheets is automatically placed in an operative position in the machine or in the sheet feeding apparatus for feeding from the top of the stack merely by inserting a receptacle holding the stack of sheets into the machine or the feeding apparatus.

It is another object of the present invention to provide a sheet loading and storing assembly for use as above stated in which the mechanism which places the stack of sheets into the operative position is automatically moved to an inoperative position and does not interfere with insertion and removal of the sheet receptacle merely by the act of inserting and removing the receptacle.

These and other objects and advantages of the present invention will become more apparent from an understanding of the following detailed description of presently preferred modes contemplated for carrying out the present invention, when considered in conjunction with the accompanying drawings in which.

DETAILED DESCRIPTION OF THE PREFERRED EMBODIMENT

Figure 1:
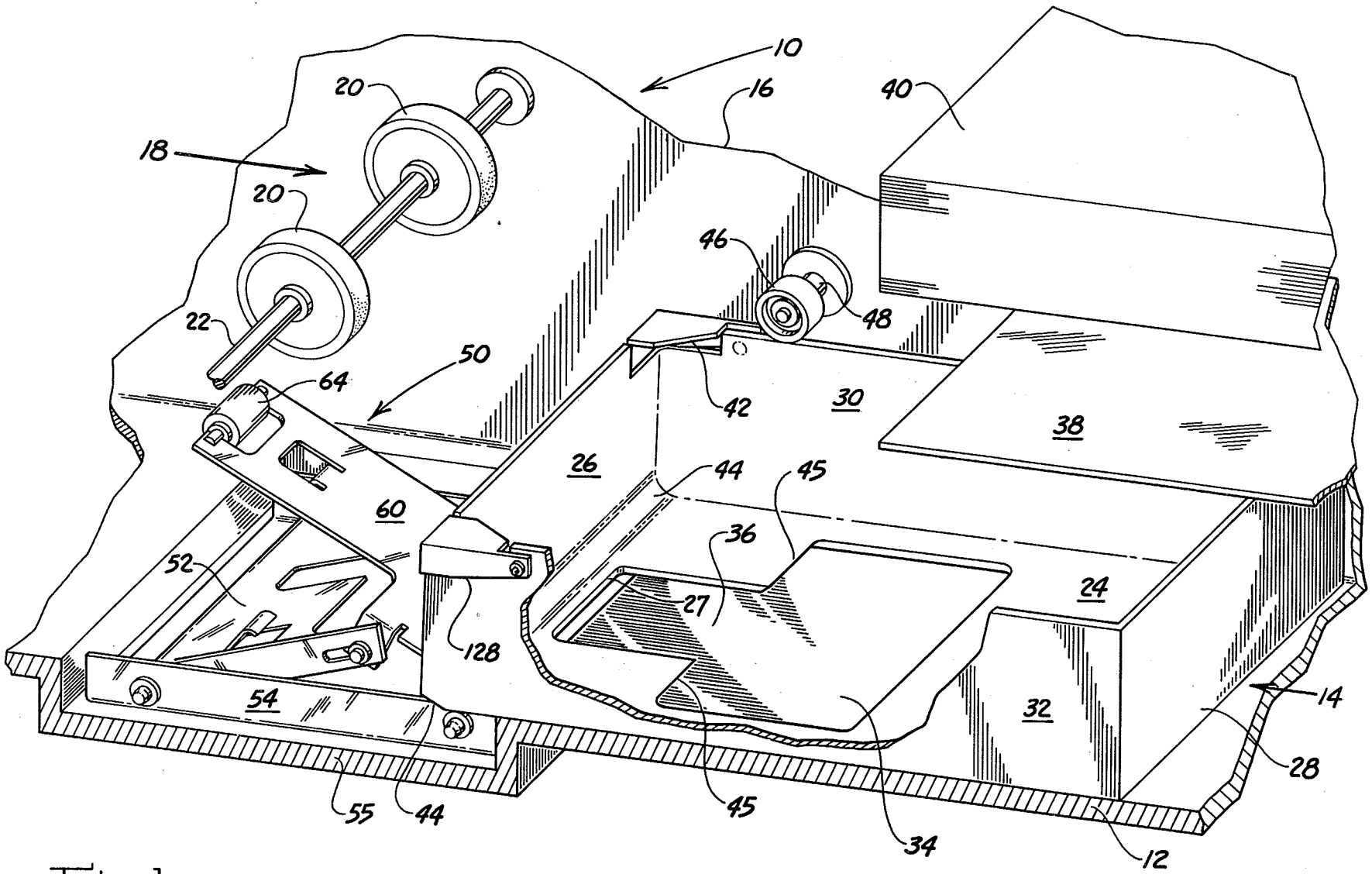
FIG. 1 is a perspective, partly exploded view of a sheet loading and storing assembly embodying the principles of the present invention.

Referring now to the drawings and in particular to FIG. 1 thereof, the sheet loading and storing assembly of the present invention is seen to comprise a frame generally designated by the reference numeral 10, the frame being either a portion of the machine such as a copying machine, in which sheets of paper are utilized in some manner such as for making copies, or the frame 10 is part of an independent unit which constitutes merely a sheet feeding apparatus adapted to feed sheets to another machine or apparatus which receives the sheets for some purpose not related to the present invention. In any event, the frame 10 has at least a bottom wall support member 12 for supporting a tray, receptacle or cassette generally designated by the numeral 14 and further described hereinbelow. The frame 10 also has upstanding side walls 16 or other suitable members for supporting a feeding device generally designated by the numeral 18. The feeding device 18, which can be of any suitable construction, is shown as a pair of friction feed rollers 20 fixedly mounted on a shaft 22 which in turn is rotatably mounted in the side walls 16. Any suitable means may be employed to rotate the shaft 22 to feed sheets of paper seriatim when a stack of sheets is in feeding position as more fully described below.

The receptacle 14 is generally a rectangular tray dimensioned to receive a specific size paper, such as $8\frac{1}{2}\times 11$ and comprises a bottom wall 24, a front wall 26, a rear wall 28 and side walls 30 and 32. The bottom wall has an opening therein which has a relatively wide portion 34 generally centrally located in the tray 14 and a narrow portion 36 projecting forwardly from the wide portion 34. This opening is to permit access by the elevating mechanism (hereinafter described) to a removable support member 38 which is received within the tray 14 and which actually supports the stack of sheets 40. By virtue of the elevating mechanism moving the support 40 upwardly within the tray 14, the topmost sheet of the stack 40 is brought into feeding engagement with the feed rollers 20. The receptacle 14 may also be provided with any of a variety of well known corner separators 42 which prevent the feed rollers 20 from feeding more than one sheet of paper at a time from the stack 40.

The lower front corner of the tray 14 is leveled so as to form a short slanted wall 44 which constitutes a forwardly facing camming surface. Also, the forward edges 45 in the bottom wall which define the front of the wide portion of the opening 34 in the bottom wall are beveled to form a pair of rearwardly facing camming surfaces. The purposes of both the forwardly facing and rearwardly facing camming surfaces are to engage with corresponding camming surfaces on the elevating mechanism in order to cause the latter to be depressed in a manner which will be fully described hereinbelow.

A guide roller 46 is rotatably mounted on a stub shaft 48 which in turn is mounted on the side wall 16. Another guide roller is mounted on the opposite side wall. The purpose of these guide rollers is to ride along the upper edges of the side walls 30 and 32 of the tray as the latter is being inserted into the machine to prevent the tray 14 from being lifted as it passes over the elevating mechanism, thereby forcing the elevating mechanism to be depressed to an inoperative position as will more clearly be seen hereinafter.

Figure 2:
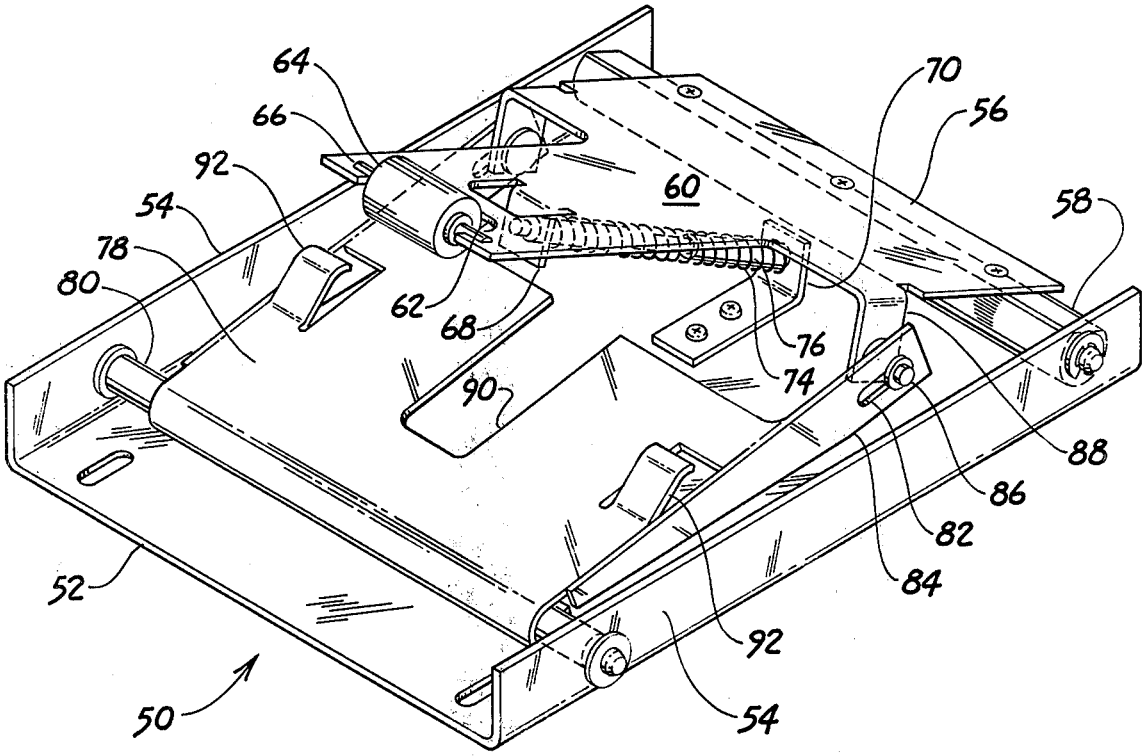
FIG. 2 is a perspective view of the elevating mechanism of the assembly shown in FIG. 3.

The elevating mechanism, generally referred to by the reference numeral 50 in FIGS. 1 and 2, to which reference is now made, is seen to comprise a frame having a bottom wall 52 and a pair of short upstanding side walls 54. The frame is adapted to be secured within a recessed portion 55 of the bottom wall 12 of the frame 10 so as to fix the position of the elevating mechanism with respect to the feed rollers 20. The elevating mechanism further comprises a first lifting member 56 which is a generally rectangular plate suitably secured along its rear edge to a shaft 58 which in turn is journaled for rotation in the short side walls 54 of the frame 50. The lifting member 56 has a forwardly projecting extension 60 into which is fitted a roller 64 rotatably carried by a shaft 66 mounted adjacent the free end of the extension 60 of the lifting member 56.

The extension 60 is provided with a downwardly projecting tab 68, and the bottom wall 52 of the frame is provided with an upwardly projecting tab 70. A rod 72 (see FIG. 3) is suitably mounted in the tabs 68 and 70 so as to be slidably held by one end and fixedly held by the other, and a compression spring 74 is mounted on the rod 72. A pair of spacers 76 may be provided to assist the compression spring in maintaining its shape. By this construction, the lifting member 56 is biased upwardly with respect to the frame 50 with sufficient force to raise the front edge of the support member 38 and the stack of sheets 40 when the tray is in its operative position in the machine or the feeding apparatus, and the lifting member can pivot upwardly and downwardly about the shaft 58.

A depressing member 78 is suitably secured to a shaft 80 which is journaled for rotation in the short side walls 54 of the frame 50 adjacent the forward edge of the latter. The depressing member extends rearwardly and is connected to the elevating member 56 by means of a lost motion connection such as the pin and slot connection illustrated, the slot 82 being located adjacent the rear edge of a downwardly extending side wall 84 of the depression member 78. The pin 86 which passes through the slot 82 is carried by a downwardly projecting tab 88 connected to the elevating member 56. Corresponding pin and slot connection construction is located on the opposite side of the elevating member and depressing member. By virtue of this pin and slot connection, the elevating member 56 can be moved from an upper position to a lower position by pressing downwardly on the depressing member 78 with sufficient force to overcome the force of the compression spring 74. It will be seen that the depressing member is provided with a centrally located slot 90 formed therein in order to accommodate the tab 68 and the compression spring 74 when the elevating member 56 is depressed to its lower position. The depressing member is also provided with a pair of upstanding rearwardly extending tabs 92 located adjacent the side edges of the depressing member 78 and about midway along its length, these tabs constituting camming surfaces for depressing the depressing member 78 when the tray is withdrawn from the machine in a manner yet to be described.

Figure 3:
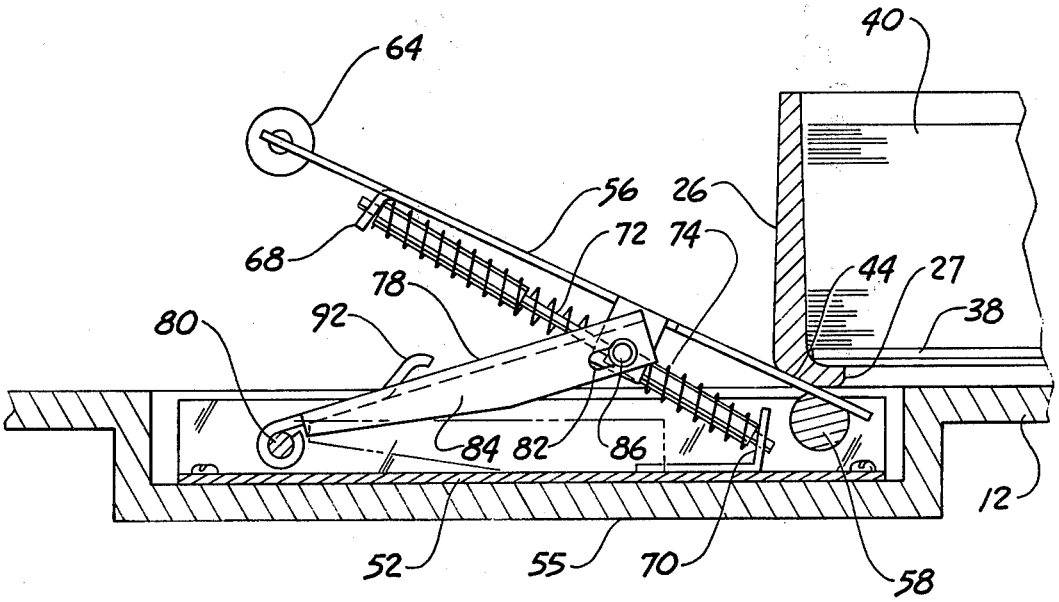
FIG. 3 is a fragmentary sectional view of the assembly shown in FIG. 1 showing the parts as the tray is being inserted.
Figure 7:
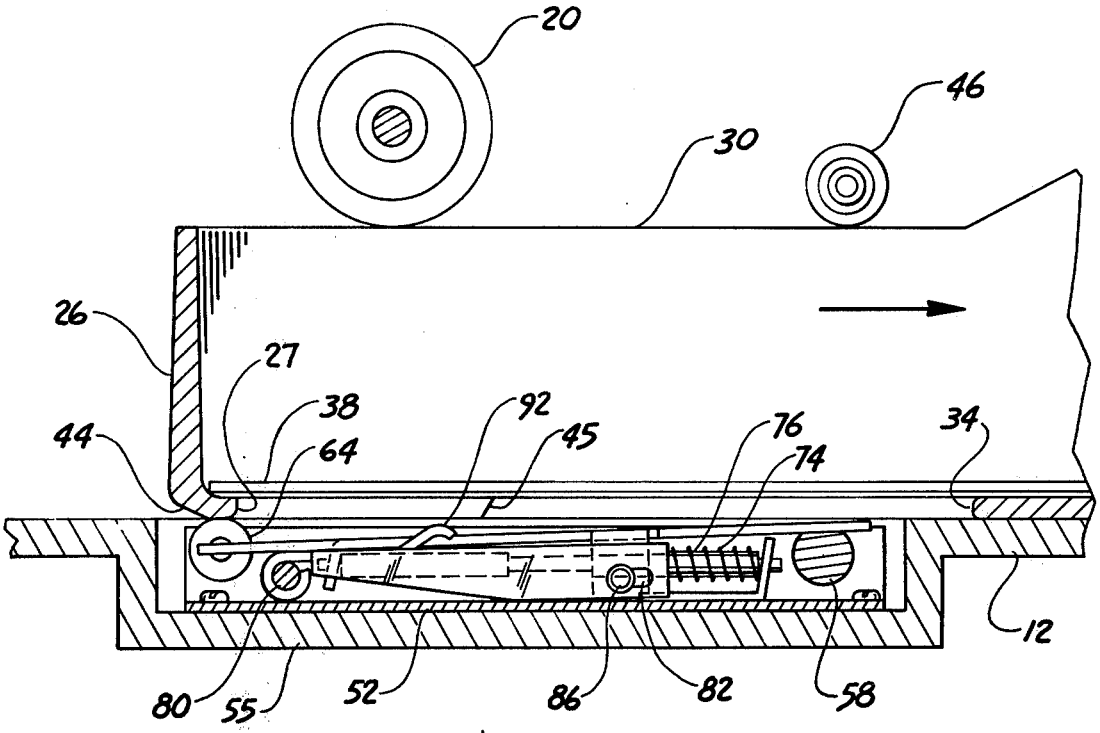

From the foregoing description, the operation of the loading and storing assembly will be apparent. FIG. 3 shows the positions of the parts where a fully loaded receptacle or tray 14 is being inserted into the machine or feeding apparatus as the case may be. It will be seen that the elevating member 56 is in its uppermost position and the forwardly facing camming surface 44 of the tray has just come into contact with the elevating member 56 adjacent the lower end thereof. The upper surface of the elevating member 56 constitutes in effect a camming surface which is engaged by the camming surface 44 of the tray. As the tray is pushed forwardly or toward the left as viewed in FIG. 3, the camming surface 44 slides across the upper surface of the elevating member 56 and forces the elevating member 56 downwardly about the axis of the shaft 58, thereby lowering the roller 64 to a fully depressed position as seen in FIG. 7. The rollers 46 engaging the upper edges of the side walls 30 and 32 of the tray ensure that the elevating mechanism will be depressed rather than the forward end of the tray being lifted. When the tray has been inserted sufficiently for the forward edge 27 of the narrow portion 36 of the opening in the tray bottom to clear the roller 64, the latter is then free to move upwardly within the tray as a result of the force being exerted on the lifting member 56 by the spring 74. Since the supporting member 38 is in the tray and supporting a stack of sheets 40, the effect of the upward movement of the roller 64 is to raise the support member 38 sufficiently to cause the uppermost sheet of the stack to be pressed into feeding engagement with the feed rollers 20 for feeding of individual sheets seriatim upon actuation of the driving means acting through the shaft 22. It will be apparent that as sheets are fed from the stack and the latter is depleted, the lifting member being constantly biased upwardly, will cause the roller 64 to follow the depletion of the stack and maintain succesive uppermost sheets in contact with the feed rollers 20.

Figure 4:
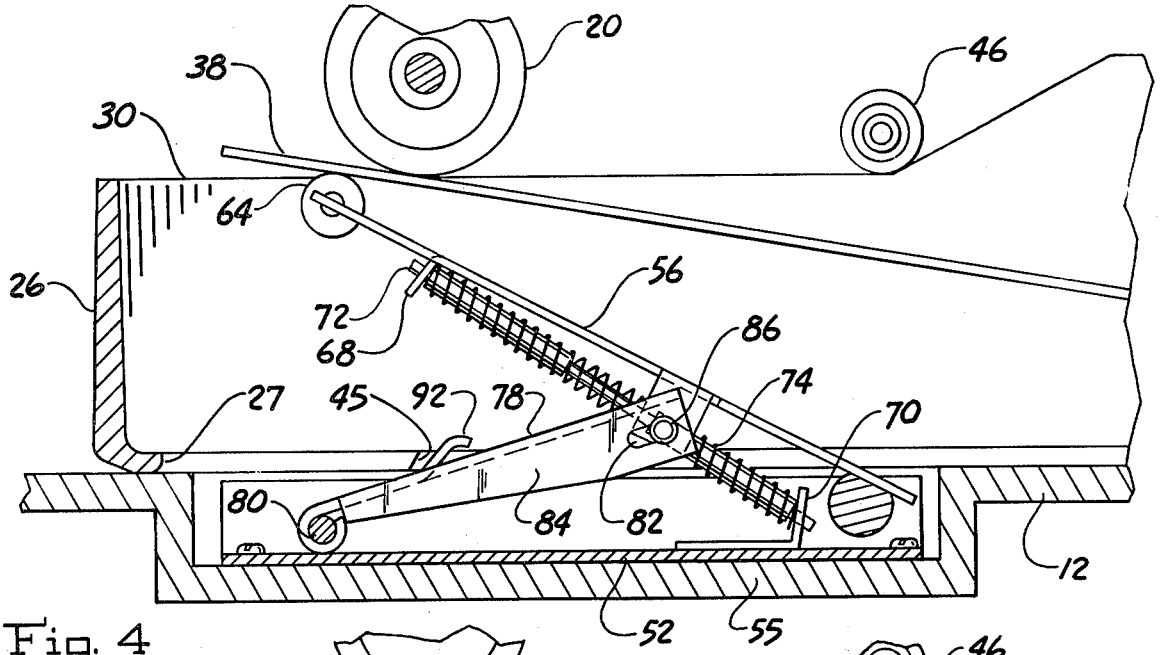
FIGS. 4–8 are views similar to FIG. 3 showing the parts in various positions during withdrawal of the tray.
Figure 5:
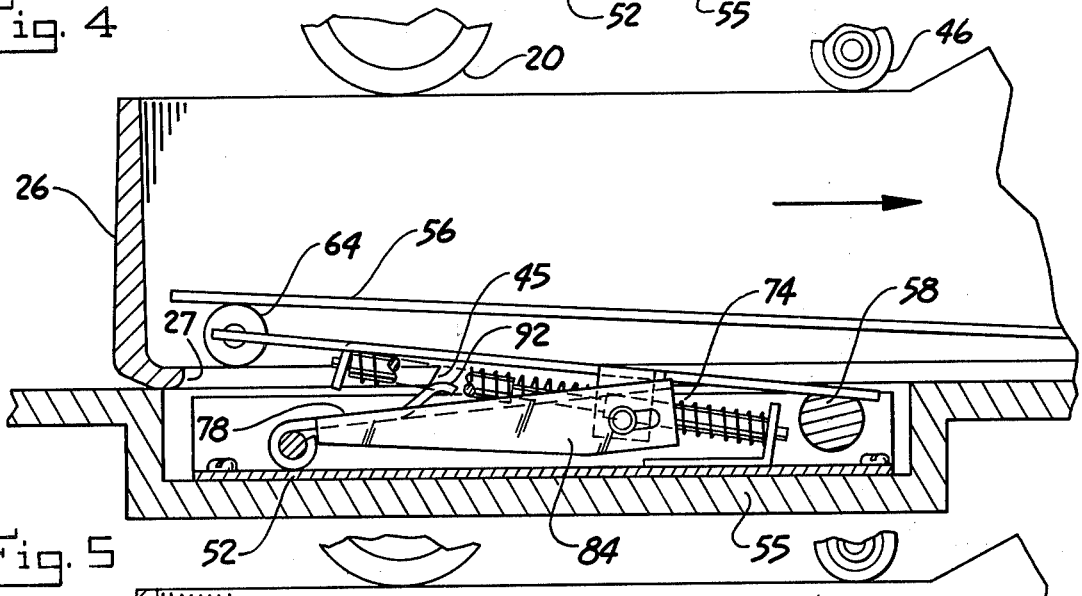
Figure 6:
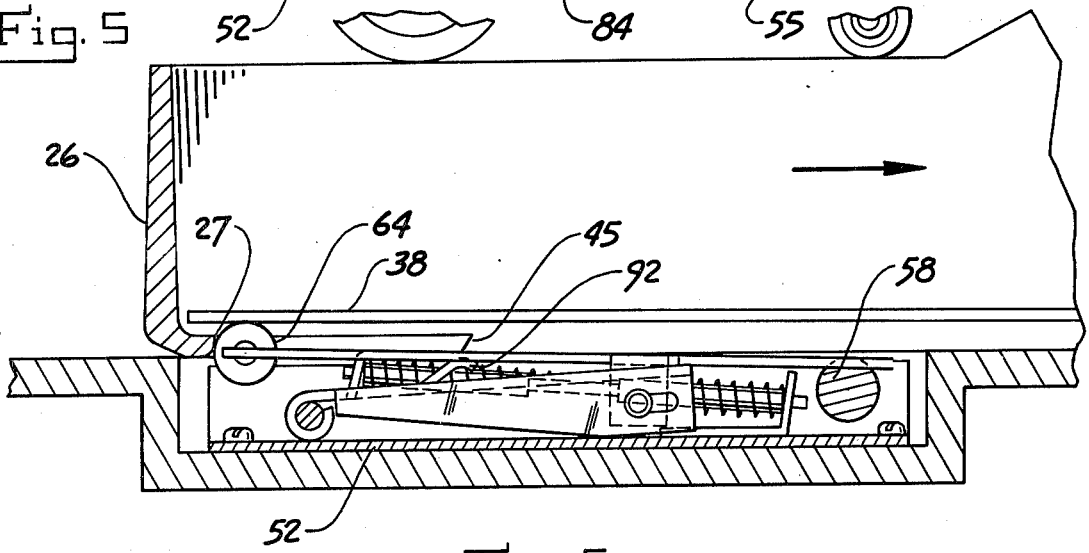
Figure 8:
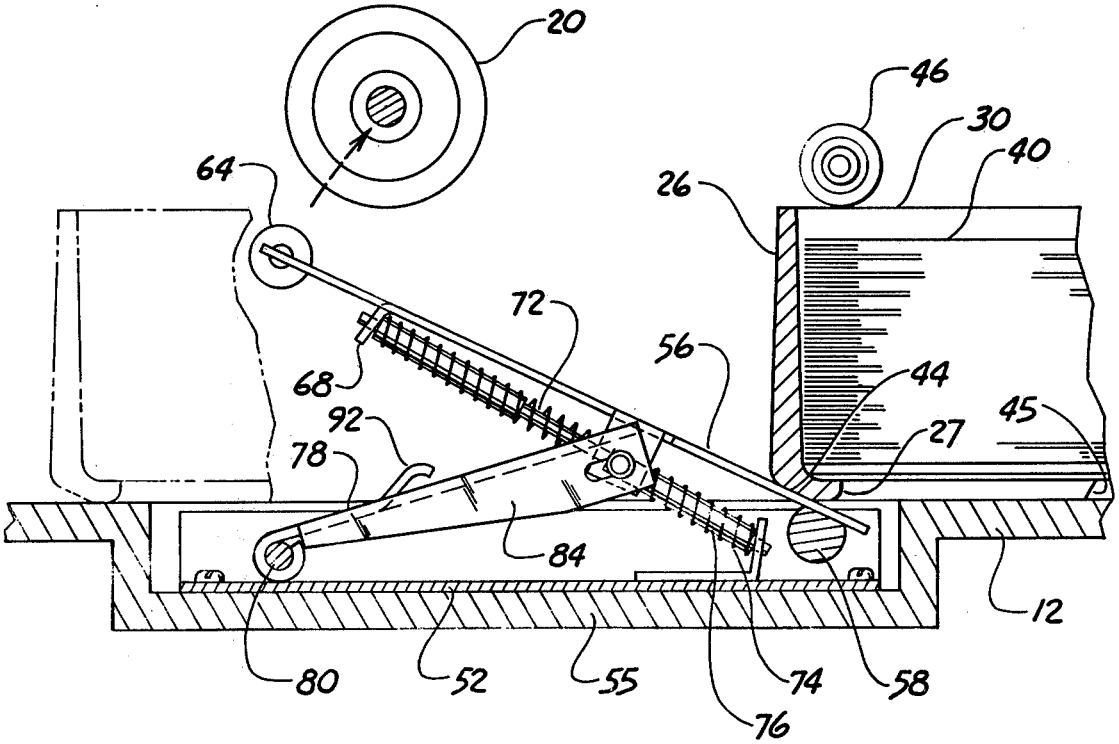

When all of the sheets in the stack have been fed from the tray, the parts will be in the positions shown in FIG. 4, with the support member 38 in contact with the feed rollers 20. At this point, it is necessary to remove the tray or receptacle for reloading, and to do this it is again necessary to depress the elevating mechanism to its inoperative position. Thus, as the tray is moved rearwardly from the position shown in FIG. 4 to that shown in FIG. 5, the rearwardly facing camming surfaces 45 on the bottom of the tray contact the upper surfaces of the tabs 92, which constitute in effect camming surfaces for sliding engagement with the rearwardly facing camming surfaces 45 of the tray. Thus, the sliding engagement of these camming surfaces, as the tray is moved rearwardly, depresses the depressing member 78 from the position shown in FIG. 4 to that shown in FIG. 5. As the depressing member 78 moves downwardly, it pulls the elevating member 56 downwardly by virtue of the pin and slot connection 86 and 82 between the depressing member 78 and the elevating member 56. FIG. 5 shows an intermediate position of the parts. As the camming surfaces 45 continue to move over the camming surfaces on the tabs 92, the depressing member 78 and the elevating member 56 are moved further downwardly to the positions shown in FIG. 6 in which the forward edge 27 of the bottom of the tray contacts the roller 64. Further rearward movement of the tray causes the edge 27 to push downwardly on the roller 64 so that the elevating member 56 is further depressed, thereby allowing the edge 27 of the tray bottom to ride over the roller 64 as shown in FIG. 7. At this point the elevating mechanism is fully depressed and the tray can be freely withdrawn from the machine or feeding apparatus, as the case may be. Upon further withdrawal of the tray from the position shown in FIG. 7, the elevating mechanism will return to its normal position as shown in FIG. 8 as the forwardly facing camming surface 44 retracts across the upper surface of the elevating member 56.

From the foregoing it will be seen that the loading and storing assembly of the present invention fulfills the need for a simple and effective device for loading a stack of sheets into a machine or feeding apparatus and having the stack of sheets automatically placed in operative engagement with a feeding device merely by the act of inserting a tray containing the stack of sheets, coupled with automatically rendering inoperable during insertion and withdrawal of the tray an elevating mechanism which places the stack of sheets in the operative position and would normally interfere with the insertion and withdrawal of the sheets.

What is claimed is:

1. In a machine which utilizes individual sheets of paper stored therein as a stack of sheets and having feeding means for feeding the uppermost sheet from the stack, the improvement in means for loading and storing a stack of sheets in operative position in the machine for feeding of individual sheets seriatim from the top of the stack, said improvement comprising:

A. a receptacle removably disposed in the machine in an operative position for holding a stack of sheets, said receptacle having an opening in the bottom wall thereof and a movable support member received therein for supporting the stack of sheets;

B. movable elevating means mounted in the machine for automatically elevating said support member in said receptacle to bring the uppermost sheet of the stack into feeding engagement with the feed means when said receptacle is in said operative position, said elevating means comprising 1. an elevating member pivotably connected to the machine and adapted to extend upwardly through said opening in the bottom wall of said receptacle when said receptacle is in said operative position,
2. means normally biasing said elevating member upwardly, and
3. a depressing member pivotably connected to the machine and pivotably connected to said elevating member for depressing said elevating member to an inoperative position when said depressing member is depressed; and C. means on said receptacle and said elevating means operatively engaging each other when said receptacle is being inserted into and removed from the machine for automatically moving said elevating means to an inoperative position in which said elevating means is depressed beneath said receptacle, whereby said receptacle is inserted into and removed from the machine without interference with said elevating means and said elevating means is automatically rendered operable after insertion of said receptacle.

2. The improvement as set forth in claim 1 wherein said elevating member carries a roller at the free end thereof, said roller pressing on the lower surface of said support member in said receptacle when said receptacle is in said operative position.

3. The improvement as set forth in claim 1 wherein said elevating member and said depressing member are connected through a lost motion connection to allow both said members to move upwardly and downwardly together.

4. The improvement as set forth in claim 1 wherein a portion of the upper surface of said elevating member constitutes a rearwardly facing camming surface, and said depressing member includes a means defining a forwardly facing camming surface, said camming surfaces being adapted to be engaged by said receptacle during insertion and removal thereof respectively for depressing said elevating means to said inoperative position.

5. The improvement as set forth in claim 4 wherein the lower front edge of said receptacle is beveled to form a slanted wall constituting a forwardly facing camming surface for engaging said rearwardly facing camming surface on said elevating member so as to depress said elevating member to said inoperative position when said receptacle is being inserted into the machine.

6. The improvement as set forth in claim 4 wherein the forward edge of said bottom wall adjacent said opening is beveled to form a slanted edge constituting a rearwardly facing camming surface for engaging said forwardly facing camming surface on said depressing member so as to depress said depressing member and said elevating member to said inoperative positions when said receptacle is being withdrawn from the machine.

7. Apparatus for feeding individual sheets of paper seriatim from the top of a stack of sheets stored in the apparatus, said apparatus comprising:

A. a frame;

B. sheet feeding means mounted on said frame;

C. a receptacle removably disposed on said frame in an operative position, said receptacle having an opening in the bottom wall thereof and a movable support member received therein for supporting the stack of sheets, and said frame comprising a first portion for receiving said receptacle when said receptacle is being inserted into said frame and for supporting said receptacle in said operative position and a second portion lower than said first portion defining a recessed portion of said frame;

D. movable elevating means mounted in said recessed portion of said frame for automatically elevating said support member in said receptacle to bring the uppermost sheet of the stack into feeding engagement with said feeding means when said receptacle is in said operative position, said movable elevating means comprising 1. an elevating member pivotably connected to said frame in said recessed portion thereof,
2. a depressing member pivotably connected to said frame in said recessed portion thereof at a location spaced from the pivotable connection of said elevating member to said frame, and
3. lost motion means interconnecting said elevating member and said depressing member for causing said members to move upwardly and downwardly together;

E. means on said receptacle and said elevating means operatively engaging each other when said receptacle is being inserted into and removed from said frame for automatically moving said elevating means to an inoperative position in which said elevation means is depressed beneath said receptacle, whereby said engaging means on said receptacle and said elevating means moves both said elevating member and said depressing member into said recessed portion of said frame when said receptacle is being inserted into or withdrawn from said frame to prevent interference of the receptacle with said elevating means, and whereby said elevating means is automatically rendered operable after insertion of said receptacle; and F. means for normally biasing said elevating means upwardly, said elevating means being depressed entirely within said recessed portion of said frame when said elevating means is moved to said inoperative position by engagement means on said receptacle and said elevating means.

* * * * *

UNITED STATES PATENT AND TRADEMARK OFFICE

CERTIFICATE OF CORRECTION

PATENT NO. : 4,219,192

DATED : August 26, 1980

INVENTOR(S) : James E. Burke

It is certified that error appears in the above-identified patent and that said Letters Patent are hereby corrected as shown below:

Column 1, line 30 change "top most" to -- topmost --.

Column 1, line 40 change "accesible" to -- accessible --.

Column 6, line 1 change "succesive" to -- successive --.

Column 8, line 43 change "elevation" to -- elevating --.

Signed and Sealed this

*Thirteenth* Day of *October 198*

[SEAL]

*Attest:*

GERALD J. MOSSINGHOFF

*Attesting Officer*

*Commissioner of Patents and Trademarks*